US010662026B2

(12) United States Patent
Choi

(10) Patent No.: US 10,662,026 B2
(45) Date of Patent: May 26, 2020

(54) GUIDANCE PRESENTING DEVICE AND GUIDANCE PRESENTING METHOD

(71) Applicant: MITSUBISHI ELECTRIC CORPORATION, Tokyo (JP)

(72) Inventor: Eunjin Choi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/094,622

(22) PCT Filed: May 13, 2016

(86) PCT No.: PCT/JP2016/064307

§ 371 (c)(1),
(2) Date: Oct. 18, 2018

(87) PCT Pub. No.: WO2017/195354

PCT Pub. Date: Nov. 16, 2017

(65) Prior Publication Data

US 2019/0106291 A1 Apr. 11, 2019

(51) Int. Cl.

*B66B 3/00* (2006.01)
*B66B 3/02* (2006.01)
*B66B 5/00* (2006.01)

(52) U.S. Cl.

CPC ..... *B66B 3/002* (2013.01); *B66B 3/00* (2013.01); *B66B 3/02* (2013.01); *B66B 5/0012* (2013.01)

(58) Field of Classification Search

CPC .. B66B 3/00; B66B 3/002; B66B 3/02; B66B 5/0012

(Continued)

(56) References Cited

U.S. PATENT DOCUMENTS

2005/0098391 A1* 5/2005 Rintala ..... B66B 1/20 187/396
2012/0125719 A1* 5/2012 Sundholm ..... B66B 1/2458 187/382

(Continued)

FOREIGN PATENT DOCUMENTS

JP 9-156846 A 6/1997
JP 2001-186096 A 7/2001

(Continued)

OTHER PUBLICATIONS

International Search Report (PCT/ISA/210) issued in PCT/JP2016/064307, dated Aug. 2, 2016.

(Continued)

*Primary Examiner* — Hirdepal Singh
(74) *Attorney, Agent, or Firm* — Birch, Stewart, Kolasch & Birch, LLP

(57) ABSTRACT

A guidance content determining unit which determines first guidance content which is content represented to a user in a car on the basis of a situation in an elevator landing detected by a landing situation detecting unit and determines second guidance content being content represented to a user in the elevator landing on the basis of a situation in the car detected by an in-car situation detecting unit is provided, a guidance presenting unit presents the first guidance content determined by the guidance content determining unit to the user in the car, and a guidance presenting unit presents the second guidance content determined by the guidance content determining unit to the user in the elevator landing.

5 Claims, 10 Drawing Sheets

(58) Field of Classification Search
USPC ..... 340/540
See application file for complete search history.

(56) References Cited

U.S. PATENT DOCUMENTS

| | | | | |
|---|---|---|---|---|
| 2016/0318733 | A1* | 11/2016 | Suoranta | B66B 3/006 |
| 2017/0267487 | A1* | 9/2017 | Pasini | B66B 3/006 |
| 2018/0273345 | A1* | 9/2018 | Rao | B66B 1/468 |

FOREIGN PATENT DOCUMENTS

| | | | | |
|---|---|---|---|---|
| JP | 2003-267637 | A | | 9/2003 |
| JP | 2003-267642 | A | | 9/2003 |
| JP | 2003-312947 | A | | 11/2003 |
| JP | 2004-10264 | A | | 1/2004 |
| JP | 4519468 | B2 | | 8/2010 |
| JP | 2013-56751 | A | | 3/2013 |
| JP | 2013-113824 | A | | 6/2013 |
| JP | 2013113824 | A | * | 6/2013 |
| JP | 2017178589 | A | * | 10/2017 |
| JP | 6333711 | B2 | * | 5/2018 |
| KR | 10-1998-020685 | A | | 6/1998 |

OTHER PUBLICATIONS

Korean Office Action for Korean Application No. 10-2018-7032431, dated Sep. 30, 2019, with English translation.

* cited by examiner

GUIDANCE PRESENTING DEVICE AND GUIDANCE PRESENTING METHOD

TECHNICAL FIELD

The present invention relates to a guidance presenting device and a guidance presenting method for presenting guidance to a user who uses an elevator.

BACKGROUND ART

There is a guidance presenting device which displays a current floor, an arrival floor, emergency information and the like on a display attached to a wall surface or the like in an elevator car.

Patent Literature 1 below discloses a configuration in which a light emitting device installed on a floor emits light to guide a user to an area near an inner wall surface except a car door.

CITATION LIST

Patent Literatures

Patent Literature 1: JP 2013-56751 A

SUMMARY OF INVENTION

Technical Problem

Since the conventional guidance presenting device is configured as described above, the user can be guided to the area near the inner wall surface except the car door, but on the display attached to the wall surface or the like in the car, only preset information is displayed. Therefore, there is a problem in that guidance according to a situation in the car and a situation in an elevator landing cannot be presented to the user.

The present invention is achieved to solve the above-described problem, and an object thereof is to obtain a guidance presenting device and a guidance presenting method capable of presenting guidance according to a situation in a car and the situation in an elevator landing to the user.

Solution to Problem

A guidance presenting device according to the present invention is a guidance presenting device includes a processor; and a memory storing instructions which, when executed by the processor, causes the processor to perform processes of: detecting a situation in a car of an elevator; determining second guidance content being content represented to a user in an elevator landing on a basis of the detected situation in the car; and presenting the determined second guidance content to the user in the elevator landing, wherein the processor detects a congestion situation in the car as the situation in the car, the processor determines, as the second guidance content, guidance content indicating the detected congestion situation in the car, and the processor further performs processes of receiving destination information indicating a destination floor of the user from an information terminal of the user, wherein the processor estimates the congestion situation in the car after some of users in the car get off on the elevator landing on a basis of on a basis of the received destination information which indicates the destination floor and the detected congestion situation in the car, and determines the guidance content indicating the estimated congestion situation in the car as the second guidance content.

Advantageous Effects of Invention

According to the present invention, it is configured such that the guidance content determining unit which determines the first guidance content which is the content represented to the user in the car on the basis of the situation in the elevator landing detected by the landing situation detecting unit and determines the second guidance content being the content represented to the user in the elevator landing on the basis of the situation in the car detected by the in-car situation detecting unit is provided, the first guidance presenting unit presents the first guidance content determined by the guidance content determining unit to the user in the car, and the second guidance presenting unit presents the second guidance content determined by the guidance content determining unit to the user in the elevator landing, so that there is an effect that it is possible to present the guidance according to the situation in the car and the situation in the elevator landing to the user.

BRIEF DESCRIPTION OF DRAWINGS

FIG. 3 is a hardware configuration diagram of a computer in a case where the guidance presenting device is implemented by software, firmware or the like.

FIG. 4 is a flowchart illustrating a guidance presenting method which is a procedure in a case where the guidance presenting device is implemented by the software, firmware and the like.

DESCRIPTION OF EMBODIMENTS

A mode for carrying out the present invention is hereinafter described with reference to attached drawings in order to describe the present invention in more detail.

First Embodiment

Figure 1:
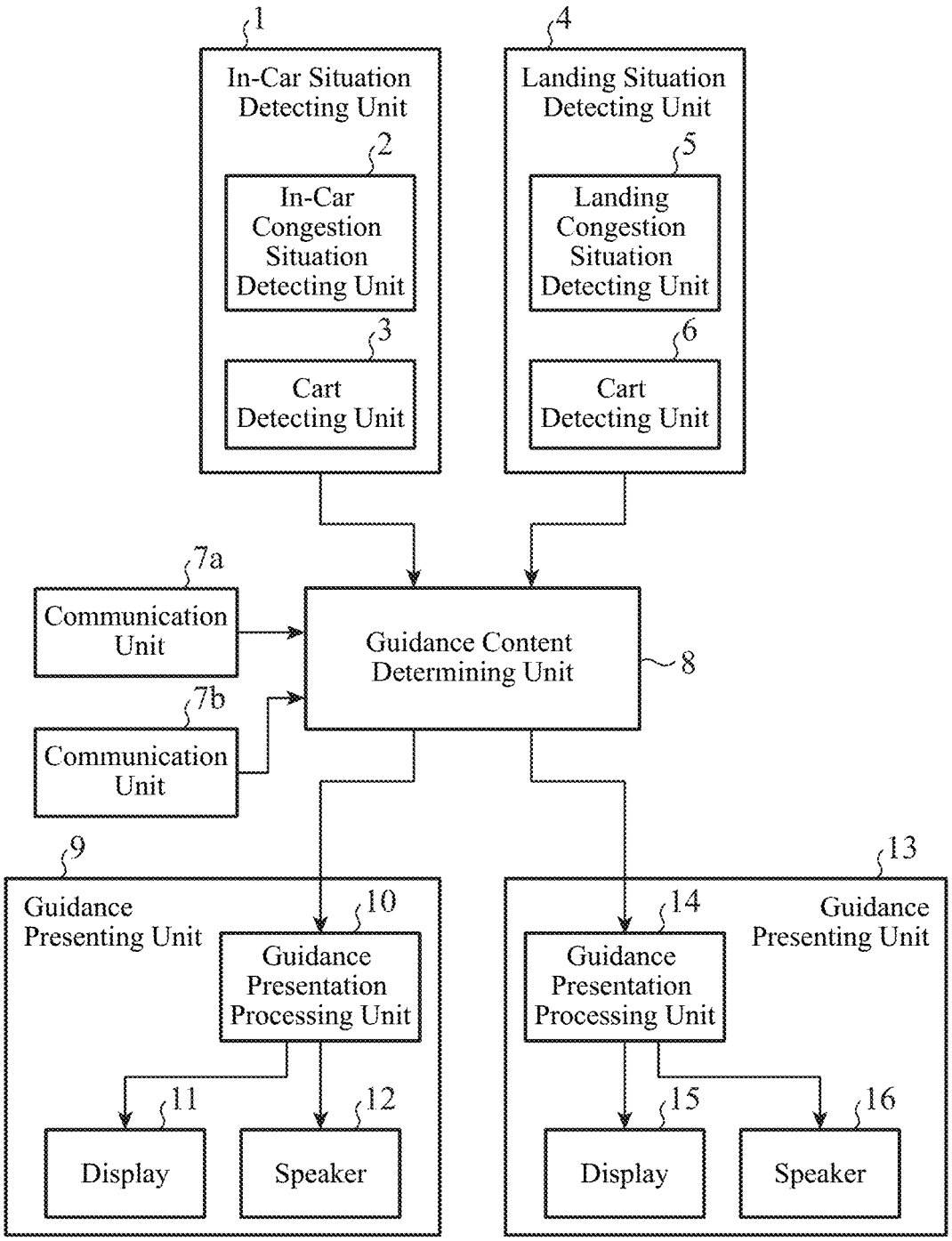
FIG. 1 is a configuration diagram illustrating a guidance presenting device according to a first embodiment of the present invention.
Figure 2:
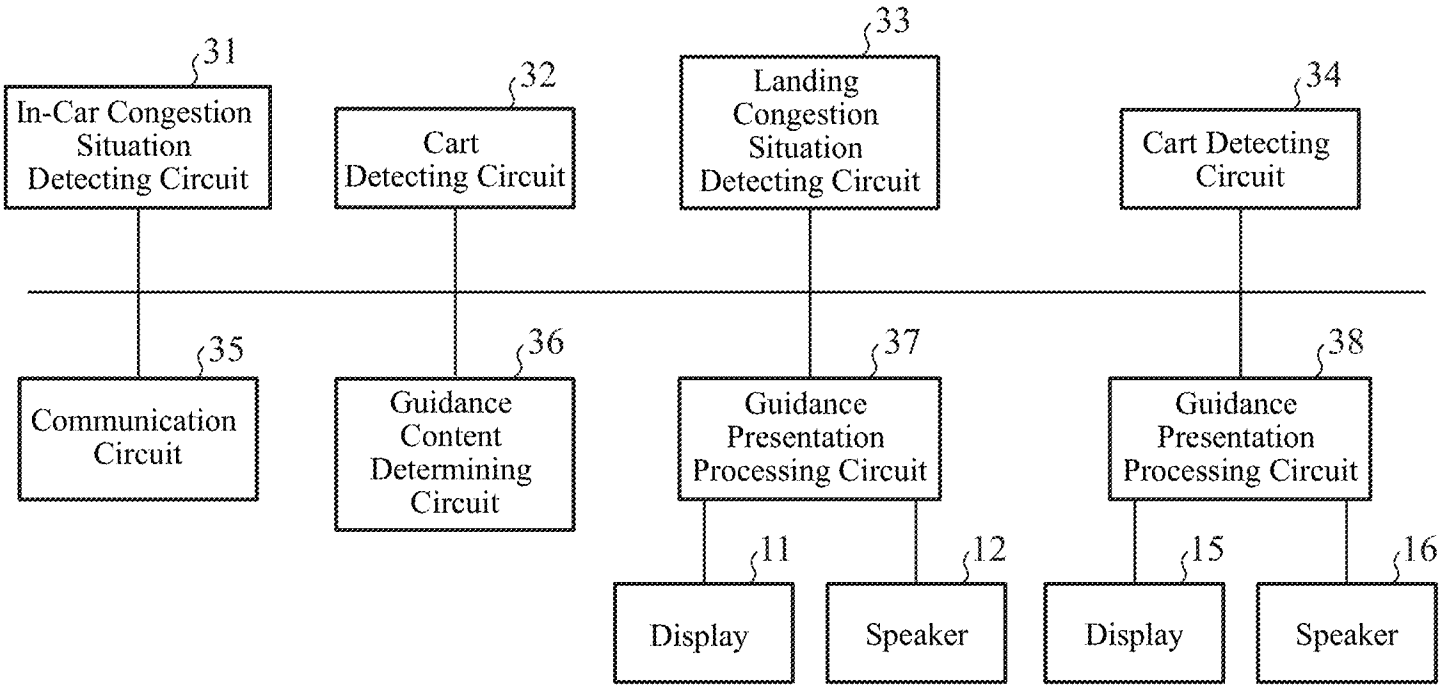
FIG. 2 is a hardware configuration diagram of the guidance presenting device according to the first embodiment of the present invention.

FIG. 1 is a configuration diagram illustrating a guidance presenting device according to a first embodiment of the present invention, and FIG. 2 is a hardware configuration diagram of the guidance presenting device according to the first embodiment of the present invention.

In FIGS. 1 and 2, an in-car situation detecting unit 1 includes an in-car congestion situation detecting unit 2 and a cart detecting unit 3, and performs processing of detecting a congestion situation in a car, a situation in which a wheelchair is present and the like, for example, as a situation in the car of an elevator.

The in-car congestion situation detecting unit 2 is implemented by, for example, an in-car congestion situation detecting circuit 31 in FIG. 2, and performs the processing of detecting the congestion situation in the car as the situation in the car.

The congestion situation in the car may be detected from, for example, an image of a camera installed on a ceiling, a wall and the like in the car, a sensing result of a weight sensor which measures a weight in the car, a sensing result of an infrared sensor which detects a user in the car and the like.

The cart detecting unit 3 is implemented by a cart detecting circuit 32 in FIG. 2, for example, and performs the processing of detecting the situation in which the wheelchair being a cart is present in the car as the situation in the car of the elevator.

In the first embodiment, an example of detecting the situation in which the wheelchair is present as the cart is described, but the cart is not limited to the wheelchair, and may be, for example, a stroller, a wagon, a carry bag and the like.

The presence of the wheelchair may be detected from, for example, the image of the camera installed on the ceiling, the wall and the like in the car and the like.

A landing situation detecting unit 4 includes a landing congestion situation detecting unit 5 and a cart detecting unit 6, and performs processing of detecting a congestion situation in an elevator landing, a situation in which a wheelchair is present and the like, for example, as a situation in the elevator landing of the elevator.

The landing congestion situation detecting unit 5 is implemented by, for example, a landing congestion situation detecting circuit 33 in FIG. 2, and performs the processing of detecting the congestion situation in the elevator landing.

The congestion situation in the elevator landing may be detected from, for example, an image of a camera installed on a ceiling, a wall of the elevator landing and the like, a sensing result of a weight sensor which is installed on a floor of the elevator landing and the like, a sensing result of an infrared sensor which detects a user in the elevator landing and the like.

The cart detecting unit 6 is implemented by a cart detecting circuit 34 in FIG. 2, for example, and performs the processing of detecting the situation in which the wheelchair is present in the elevator landing as the congestion situation in the elevator landing.

In the first embodiment, an example of detecting the situation in which the wheelchair is present as the cart is described, but the cart is not limited to the wheelchair, and may be, for example, a stroller, a wagon, a carry bag and the like.

The presence of the wheelchair may be detected from, for example, the image of the camera installed on the ceiling, the wall and the like in the elevator landing.

Communication units 7*a* and 7*b* are implemented by a communication circuit 35 in FIG. 2, for example, and receive destination information transmitted from an information terminal of the user.

The destination information is information indicating a destination floor of the user, and the information terminal of the user corresponds to, for example, a smartphone carried by the user and the like, besides a small transmitter such as a tag attached to user's clothes, the wheelchair and the like.

In the first embodiment, it is assumed that the destination information is set in advance in the information terminal of the user, and in the car or the elevator landing of the elevator, the destination information is automatically transmitted from the information terminal without special operation of the information terminal by the user.

In the first embodiment, the destination information which indicates a destination floor and is transmitted from the information terminal is used by a guidance content determining unit 8 to be described later when the congestion situation in the car is estimated, and the destination information is not used for setting the destination of the car on which the user gets. However, it is possible to use the destination information for setting the destination of the car on which the user gets.

In the first embodiment, the communication unit 7*a* is installed in the car and the communication unit 7*b* is installed in the elevator landing.

The guidance content determining unit 8 is implemented by a guidance content determining circuit 36 in FIG. 2, for example, and performs processing of determining first guidance content being content represented to the user in the car on the basis of the situation in the elevator landing detected by the landing situation detecting unit 4, and determining second guidance content being content represented to the user in the elevator landing on the basis of the situation in the car detected by the in-car situation detecting unit 1.

Specifically, the guidance content determining unit 8 performs processing of determining the guidance content indicating the congestion situation in the elevator landing detected by the landing congestion situation detecting unit 5 as the first guidance content, and determining the guidance content indicating the congestion situation in the car detected by the in-car congestion situation detecting unit 2 as the second guidance content.

When determining the second guidance content, the guidance content determining unit 8 estimates the congestion situation in the car after some of the users in the car get off on the elevator landing on the basis of the destination information which indicates the destination floor and is received by the communication unit 7*a* and the congestion situation in the car detected by the in-car congestion situation detecting unit 2 and determines the guidance content indicating the estimated congestion situation in the car.

In addition, in a case where the situation in which the wheelchair is present is detected by the cart detecting unit 6 of the landing situation detecting unit 4, the guidance content determining unit 8 performs processing of determining guidance content which indicates that the wheelchair might enter the car and which clearly indicates a space for the wheelchair to enter in the car, as the first guidance content.

In a case where the situation in which the wheelchair is present is detected by the cart detecting unit 3 of the in-car situation detecting unit 1, the guidance content determining unit 8 performs processing of determining guidance content which indicates that the wheelchair might get out of the car and which clearly indicates a route of the wheelchair getting out of the car in the elevator landing, as the second guidance content.

When determining the second guidance content, the guidance content determining unit 8 determines whether there is a space for the wheelchair to enter in the car on the basis of the congestion situation in the car detected by the in-car congestion situation detecting unit 2, and when there is no space for the wheelchair to enter in the car, determines the guidance content indicating dissuasion from getting on the car and suggestion for waiting the next car to be arrived.

A guidance presenting unit 9 being a first guidance presenting unit includes a guidance presentation processing unit 10, a display 11, and a speaker 12.

The guidance presentation processing unit 10 is implemented by a guidance presentation processing circuit 37 in FIG. 2, for example, and performs processing of presenting the first guidance content determined by the guidance content determining unit 8 to the user in the car.

The display 11 is installed on the wall, the ceiling, the floor and the like in the car and displays the first guidance content determined by the guidance content determining unit 8.

The speaker 12 is installed on the wall, the ceiling and the like in the car and outputs the first guidance content determined by the guidance content determining unit 8 by voice.

A guidance presenting unit 13 being a second guidance presenting unit includes a guidance presentation processing unit 14, a display 15, and a speaker 16.

The guidance presentation processing unit 14 is implemented by a guidance presentation processing circuit 38 in FIG. 2, for example, and performs processing of presenting the second guidance content determined by the guidance content determining unit 8 to the user in the landing.

The display 15 is installed on the wall, the ceiling, the floor and the like in the elevator landing and displays the second guidance content determined by the guidance content determining unit 8.

The speaker 16 is installed on the wall, the ceiling and the like in the elevator landing and outputs the second guidance content determined by the guidance content determining unit 8 by voice.

Although one landing situation detecting unit 4, one communication unit 7*b*, and one guidance presenting unit 13 are mounted on the guidance presenting device in FIG. 1, the landing situation detecting unit 4, the communication unit 7*b*, and the guidance presenting unit 13 are actually installed in each floor of the elevator, so that the landing situation detecting units 4, the communication units 7*b*, and the guidance presenting units 13 as many as the number of floors of the elevator are mounted on the guidance presenting device in FIG. 1.

Therefore, for example, when there are eight floors of the elevator, eight landing situation detecting units 4, eight communication units 7*b*, and eight guidance presenting units 13 are mounted.

However, it is not indispensable that the landing situation detecting units 4, the communication units 7*b*, and the guidance presenting units 13 are installed in all the floors of the elevator. For example, the landing situation detecting unit 4, the communication unit 7*b*, and the guidance presenting unit 13 may be installed only in main floors such as the first floor and the second floor.

In FIG. 1, it is supposed that the in-car congestion situation detecting unit 2, the cart detecting unit 3, the landing congestion situation detecting unit 5, the cart detecting unit 6, the communication units 7*a* and 7*b*, the guidance content determining unit 8, the guidance presentation processing unit 10, the display 11, the speaker 12, the guidance presentation processing unit 14, the display 15, and the speaker 16 being components of the guidance presenting device are implemented by dedicated hardware as illustrated in FIG. 2, that is, the in-car congestion situation detecting circuit 31, the cart detecting circuit 32, the landing congestion situation detecting circuit 33, the cart detecting circuit 34, the communication circuit 35, the guidance content determining circuit 36, the guidance presentation processing circuit 37, the display 11, the speaker 12, the guidance presentation processing circuit 38, the display 15, and the speaker 16, respectively.

Herein, each of the in-car congestion situation detecting circuit 31, the cart detecting circuit 32, the landing congestion situation detecting circuit 33, the cart detecting circuit 34, the communication circuit 35, the guidance content determining circuit 36, the guidance presentation processing circuit 37, and the guidance presentation processing circuit 38 corresponds to, for example, a single circuit, a composite circuit, a programmed processor, a parallel-programmed processor, an application specific integrated circuit (ASIC), a field-programmable gate array (FPGA), or a combination thereof.

However, the components of the guidance presenting device are not limited to those implemented by the dedicated hardware, and the guidance presenting device may also be implemented by software, firmware, or a combination of the software and firmware.

The software and firmware are stored as a program in a memory of a computer. The computer is intended to mean the hardware which executes the program, and corresponds to, for example, a central processing unit (CPU), a central processor, a processing unit, an arithmetic unit, a microprocessor, a microcomputer, a processor, a digital signal processor (DSP) and the like.

Herein, the memory of the computer corresponds to, for example, a non-volatile or volatile semiconductor memory such as a random access memory (RAM), a read only memory (ROM), a flash memory, an erasable programmable read only memory (EPROM), and an electrically erasable programmable read only memory (EEPROM), a magnetic disk, a flexible disk, an optical disc, a compact disc, a mini disc, a digital versatile disc (DVD) and the like.

Figure 3:
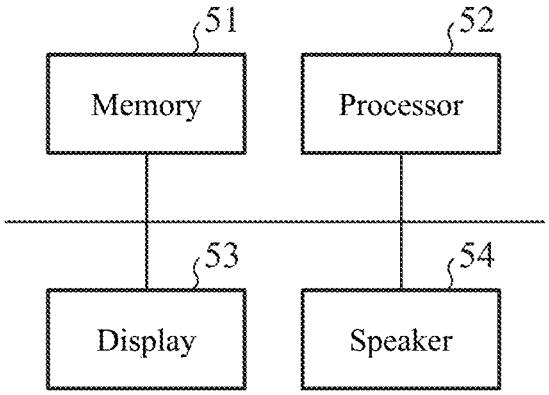

FIG. 3 is a hardware configuration diagram of the computer in a case where the guidance presenting device is implemented by the software, firmware and the like.

In a case where the guidance presenting device is implemented by the software, firmware or the like, it is possible to output the guidance content to a display 53 and a speaker 54 by storing a program for allowing the computer to execute procedures of the in-car congestion situation detecting unit 2, the cart detecting unit 3, the landing congestion situation detecting unit 5, the cart detecting unit 6, the communication units 7*a* and 7*b*, the guidance content determining unit 8, the guidance presentation processing unit 10, and the guidance presentation processing unit 14 in a memory 51, and executing the program stored in the memory 51 by a processor 52 of the computer.

Figure 4:
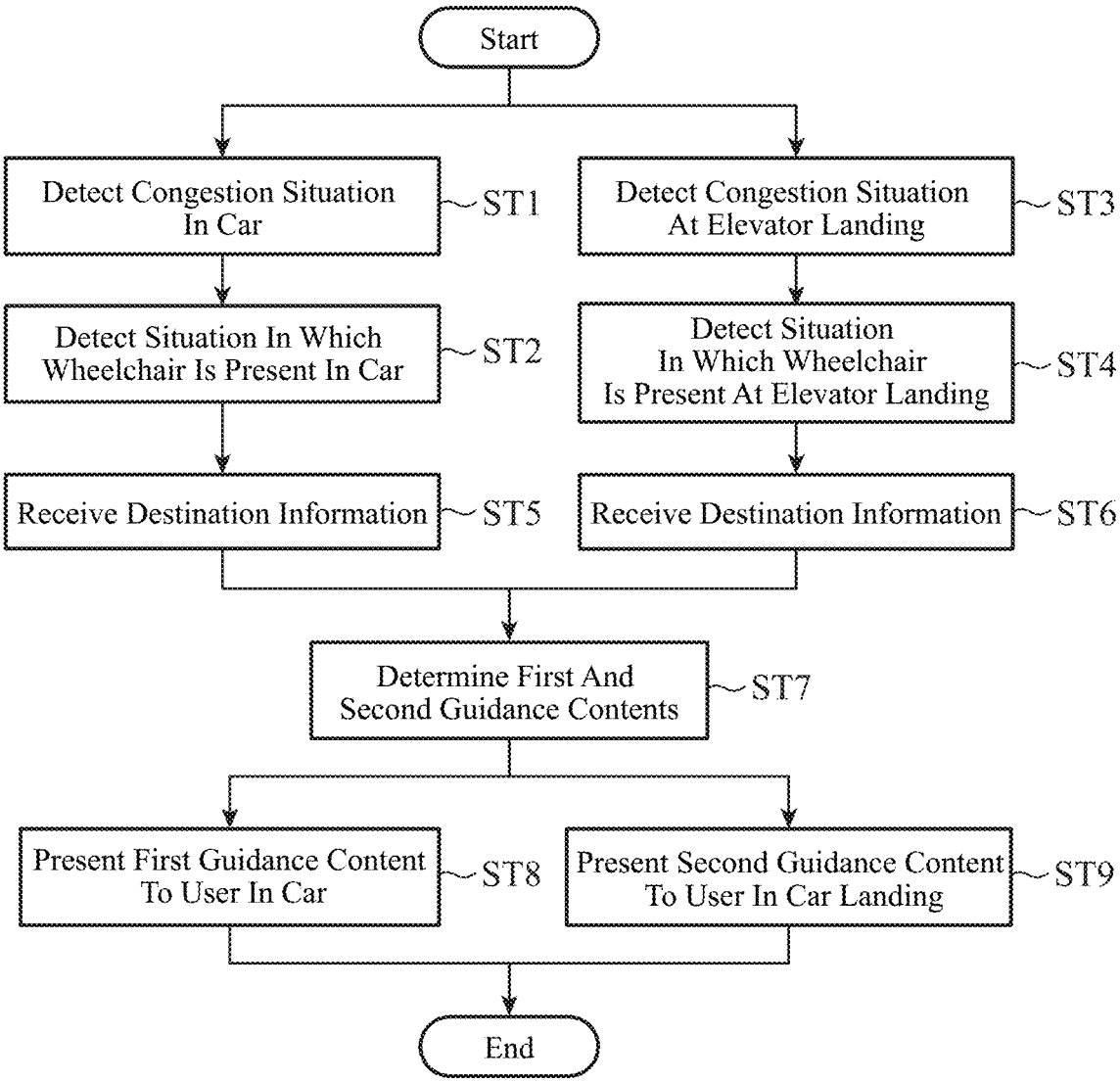

FIG. 4 is a flowchart illustrating a guidance presenting method which is a procedure in a case where the guidance presenting device is implemented by the software, firmware and the like.

Also, FIG. 2 illustrates an example in which each of the components of the guidance presenting device is implemented by the dedicated hardware, and FIG. 3 illustrates an example in which the guidance presenting device is implemented by the software, firmware and the like; however, some components in the guidance presenting device may be implemented by the dedicated hardware and remaining components may be implemented by the software, firmware and the like.

Operation is next described.

The in-car congestion situation detecting unit 2 of the in-car situation detecting unit 1 detects a congestion situation in the car of an elevator (step ST1 in FIG. 4).

The congestion situation in the car may be detected from the image of a camera installed on the ceiling, the wall and the like in the car, for example.

Specifically, the congestion situation in the car is detected as follows.

The camera installed on the ceiling in the car shoots an image of a situation in which a user is not present in the car in advance, and the in-car congestion situation detecting unit 2 stores the image of the camera (hereinafter referred to as "vacant car image").

Figure 5A:
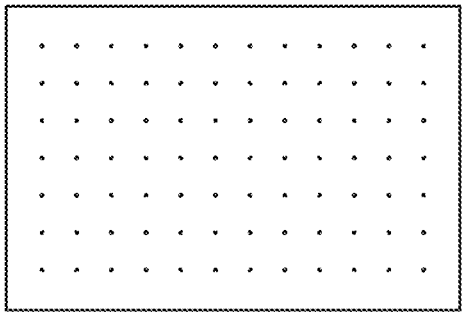
FIG. 5A is an illustrative view illustrating an image shot in a situation in which no user is present in a car.

At that time, the floor in the car appears in the vacant car image; in the first embodiment, as illustrated in FIG. 5A, an example in which a pattern including a plurality of dots is printed on the floor in the car is assumed.

The camera installed on the ceiling in the car shoots an image of a situation in which a user is present in the car, and the in-car congestion situation detecting unit 2 obtains the image of the camera.

Figure 5B:
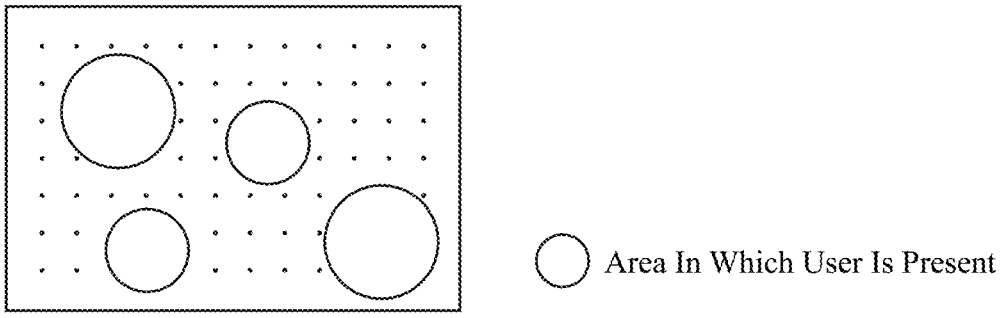
FIG. 5B is an illustrative view illustrating an image shot in a situation in which a user is present in the car.

In a case where a user is present in the car, as illustrated in FIG. 5B, the floor of the car does not appear in a position in which the user is present. Therefore, the number $N_1$ of dots in the pattern appearing in the image of the camera is smaller than the number $N_0$ of dots in the pattern appearing in the vacant car image.

FIG. 5A is an illustrative view illustrating the image shot in the situation in which there is no user in the car, and FIG. 5B is an illustrative view illustrating the image shot in the situation in which there is a user in the car.

Therefore, the in-car congestion situation detecting unit 2 counts the number $N_1$ of dots in the pattern appearing in the image of the camera, and calculates a ratio of the number $N_1$ of dots in the pattern appearing in the image of the camera to the number $N_0$ of dots in the pattern appearing in the vacant car image as expressed by the following equation (1) as a congestion situation $C_a$ in the car.

$$C_a = \frac{N_1}{N_0} \times 100 \tag{1}$$

Herein, an example in which the pattern including a plurality of dots is printed on the floor in the car is illustrated, but it is sufficient that an area of the floor shot by the camera in the situation in which there is the user in the car and an area of the floor shot by the camera in the situation in which there is no user in the car is only required to be measured, and it is not limited to a case where the pattern including a plurality of dots is printed. Therefore, for example, the floor in the car may be colored with a special color such as a fluorescent color.

It is also possible to memorize a shape of a human being in advance and perform pattern matching between the image of the camera and the memorized shape of the human being, thereby detecting human beings present in the car and detecting the congestion situation on the basis of the number of detected human beings.

Although an example of detecting the congestion situation in the car from the image of the camera is herein illustrated, it is not limited to this example; for example, the congestion situation in the car may also be detected from the sensing result of a weight sensor which measures weight in the car. In other words, the congestion situation in the car may be detected by comparing the sensing result of the weight sensor in the situation in which there is no user in the car with the sensing result of the weight sensor in the situation in which there is the user in the car.

Also, the congestion situation in the car may also be detected from the sensing result of an infrared sensor which detects the user in the car. In other words, the congestion situation in the car may be detected by comparing the sensing result of the infrared sensor in the situation in which there is no user in the car with the sensing result of the infrared sensor in the situation in which there is the user in the car.

The cart detecting unit 3 of the in-car situation detecting unit 1 detects a situation in which a wheelchair is present in the car (step ST2 in FIG. 4).

The presence of the wheelchair may be detected from, for example, an image of the camera installed on the ceiling, the wall and the like in the car and the like.

Specifically, the wheelchair has a unique shape in which two wheels are present in parallel at a predetermined interval, so that by analyzing the image of the camera, for example, it is possible to determine that there is the wheelchair when there are two circular objects arranged in parallel at a predetermined interval.

Herein, an example is illustrated in which the presence or absence of the wheelchair is determined in conformity with the presence or absence of the two circular objects arranged in parallel at a predetermined interval; however, it is also possible to memorize a shape of the wheelchair in advance and perform pattern matching between the image of the camera and the memorized shape of the wheelchair, thereby detecting the presence of the wheelchair.

The landing congestion situation detecting unit 5 of the landing situation detecting unit 4 detects a congestion situation $C_b$ in the elevator landing (step ST3 in FIG. 4).

Since the detection processing of the congestion situation by the landing congestion situation detecting unit 5 is similar to the detection processing of the congestion situation by the in-car congestion situation detecting unit 2 in the content of the detection processing except a location where the detection processing is carried out, so that the detailed description thereof is not repeated.

The cart detecting unit 6 of the landing situation detecting unit 4 detects the situation in which the wheelchair is present in the elevator landing (step ST4 in FIG. 4).

Since the detection processing of the wheelchair by the cart detecting unit 6 is similar to the detection processing of the wheelchair by the cart detecting unit 3 in the content of the detection processing except a location where the detection processing is carried out, so that the detailed description thereof is not repeated.

The communication units 7*a* and 7*b* receive destination information transmitted from the information terminal of the user (steps ST5 and ST6 in FIG. 4).

Since the communication unit 7*a* is installed in the car, the communication unit 7*a* receives the destination information transmitted from the information terminal of the user in the car, and since the communication unit 7*b* is installed in the elevator landing, the communication unit 7*b* receives the destination information transmitted from the information terminal of the user in the elevator landing.

In the first embodiment, it is assumed that all the users in the car and all the users in the elevator landing carry the information terminal which transmits the destination information, but actually, there are also users who do not carry the information terminal which transmits the destination information.

Therefore, it is also possible that the guidance content determining unit 8 described later roughly grasps the number of users in the car from the detection result of the congestion situation $C_a$ by the in-car congestion situation detecting unit 2, for example, and uses the destination information received by the communication unit 7*a* for estimating the congestion situation described later or the like only in a case where the number of pieces of destination information of the user received by the communication unit 7*a* is closer to the number of users in the car. Herein, the number close to the number of users in the car may be appropriately set, but a mode is considered in which, when a ratio of the number of pieces of destination information received by the communication unit 7*a* to the number of users in the car is, for example, 80%, 90% or the like, the number is determined to be the close number.

The guidance content determining unit 8 determines the first guidance content being the content represented to the user in the car on the basis of the situation in the elevator landing detected by the landing situation detecting unit 4, and determines the second guidance content being the content represented to the user in the elevator landing on the basis of the situation in the car detected by the in-car situation detecting unit 1 (step ST7 in FIG. 4).

Hereinafter, determination processing of the guidance content by the guidance content determining unit 8 is specifically described.

The guidance content determining unit 8 grasps the congestion situation $C_a$ in the car on the basis of the detection result of the in-car congestion situation detecting unit 2 and grasps the congestion situation $C_b$ in the elevator landing on the floor at which the car arrives next on the basis of the detection result of the landing congestion situation detecting unit 5 of the floor at which the car arrives next.

In this first embodiment, the information on the floor at which the car arrives next is obtained from a control device of the elevator not illustrated.

Next, as expressed by the following equation (2), the guidance content determining unit 8 grasps the number of users $P_a$ in the car from the detection result of the congestion situation $C_a$ by the in-car congestion situation detecting unit 2.

$$P_a = \frac{C_a \times P_{cap}}{100} \tag{2}$$

In equation (2), $P_{cap}$ represents the capacity of the car.

Herein, an example in which the guidance content determining unit 8 grasps the number of users $P_a$ in the car from the detection result of the congestion situation $C_a$ by the in-car congestion situation detecting unit 2 is illustrated; however, it is also possible to grasp the number of users $P_a$ in the car from the number of pieces of destination information received by the communication unit 7*a* in a case where all the users carry the information terminal.

When grasping the number of users $P_a$ in the car, the guidance content determining unit 8 grasps the number of users $P_{off}$ in the car who get off on the elevator landing at which the car arrives next on the basis of the destination information which indicates the destination floor and is received by the communication unit 7*a* installed in the car.

Then, as expressed by the following equation (3), the guidance content determining unit 8 estimates a congestion situation $Q_a$ in the car after some of the users get off on the next elevator landing by subtracting the number of users $P_{off}$ who get off on the next elevator landing from the number of users $P_a$ in the car and dividing the subtraction result by the capacity $P_{cap}$ of the car.

$$Q_a = \frac{(P_a - P_{off})}{P_{cap}} \times 100 \tag{3}$$

The guidance content determining unit 8 roughly grasps the number of users $P_b$ present in the elevator landing of the floor at which the car arrives next on the basis of the detection result of the congestion situation $C_b$ by the landing congestion situation detecting unit 5 on the floor at which the car arrives next. In a case where all the users carry the information terminal, it is possible to grasp the number of users $P_b$ present in the elevator landing on the basis of the number of pieces of destination information received by the communication unit 7*b* installed in the elevator landing on the floor at which the car arrives next.

The guidance content determining unit 8 determines the guidance content indicating the congestion situation $C_b$ in the elevator landing detected by the landing congestion situation detecting unit 5 as the first guidance content.

Herein, the guidance content determining unit 8 determines the guidance content indicating the congestion situation $C_b$ in the elevator landing; however, as the guidance content indicating the congestion situation $C_b$ in the elevator landing, the guidance content which indicates the number of users $P_b$ present in the elevator landing may also be used.

Also, the guidance content determining unit 8 calculates the number of persons $\Delta P = P_{cap} - P_a'$ who can get on at the next elevator landing by subtracting the number of persons in the car $P_a' = (P_a - P_{off})$ after some of the users get off at the next elevator landing from the capacity of the car $P_{cap}$. In a case where the number of users $P_b$ who are present in the elevator landing is equal to or larger than the number of persons $\Delta P$ who can get on at the next elevator landing, or in a case where the number of users $P_b$ present in the elevator landing is less than the number of persons $\Delta P$ who can get on at the next elevator landing but, for example, is 90% or more of the capacity of the car $P_{cap}$, a congestion situation is assumed, so that the guidance content determining unit 8 may determine the guidance content indicating the assumed congestion situation and a request for moving deep inside the car as the guidance content indicating the congestion situation $C_b$ in the elevator landing.

The guidance content determining unit 8 determines the guidance content indicating the congestion situation $C_a$ in the car detected by the in-car congestion situation detecting unit 2 as the second guidance content.

The guidance content determining unit 8 may make the guidance content indicating the congestion situation $C_a$ in the car the guidance content indicating not the congestion situation $C_a$ itself but the number of users $P_a$ in the car, or the number of persons $P_a' = (P_a - P_{off})$ in the car after some of the users get off on the elevator landing.

In addition, in a case where the number of users $P_b$ present in the elevator landing is larger than the number of persons $\Delta P$ who can get on at the next elevator landing, not all the users present in the elevator landing can get on, so that the guidance content determining unit 8 may determine the guidance content indicating that it might be impossible to get on due to congestion as the guidance content indicating the congestion situation $C_a$ in the car.

When determining the guidance content indicating the congestion situation $C_b$ in the elevator landing detected by the landing congestion situation detecting unit 5 as the first guidance content, the guidance content determining unit 8 determines the guidance content indicating the possibility that the wheelchair enters the car and specifying a space for the wheelchair to enter in a case where the situation in which the wheelchair is present is detected by the cart detecting unit 6 installed in the elevator landing on the floor at which the car arrives next.

When determining the guidance content indicating the congestion situation $C_a$ in the car detected by the in-car congestion situation detecting unit 2 as the second guidance content, the guidance content determining unit 8 determines the guidance content indicating the possibility that the wheelchair gets out of the car and specifying the route of the wheelchair getting out of the car in the elevator landing in a case where the situation in which the wheelchair is present is detected by the cart detecting unit 3 of the in-car situation detecting unit 1.

The guidance content determining unit 8 determines whether there is a space for the wheelchair to enter in the car the basis of the congestion situation $Q_a$ in the car after some of the users get off on the next elevator landing, and when there is no space for the wheelchair to enter in the car, determines the guidance content indicating dissuasion from getting on the car and suggestion for waiting the next car to be arrived.

The guidance content determining unit 8 estimates an area of a vacant space in the car on the basis of the congestion situation $Q_a$ in the car, for example, and when the estimated area is narrower than an area generally occupied by the wheelchair, the guidance content determining unit 8 may determine that there is no space in which the wheelchair enters.

When the guidance content determining unit 8 determines the first guidance content, the guidance presentation processing unit 10 of the guidance presenting unit 9 presents the first guidance content to the user in the car (step ST8 in FIG. 4).

That is, the guidance presentation processing unit 10 displays the guidance content indicating the congestion situation $C_b$ in the elevator landing on the display 11 installed in the car, or outputs the guidance content indicating the congestion situation $C_b$ in the elevator landing by voice from the speaker 12.

In a case where the guidance content indicating the assumed congestion situation and a request to move deep inside the car is determined by the guidance content determining unit 8, for example, as the guidance content indicating the congestion situation $C_b$ in the elevator landing, the guidance presentation processing unit 10 outputs audio indicating the assumed congestion situation from the speaker 12 and outputs audio indicating the request to move deep inside the car from the speaker 12.

Figure 6:
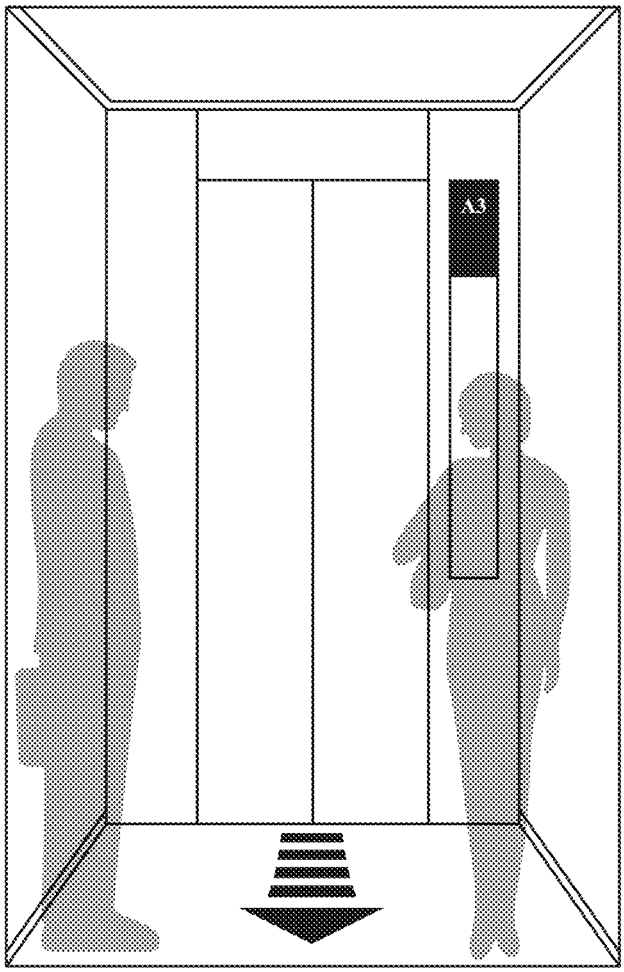
FIG. 6 is an illustrative view illustrating a state in which a display 11 installed on a floor in the car displays an arrow urging to move deep inside the car.

Also, as illustrated in FIG. 6, the guidance presentation processing unit 10 displays a symbol such as an arrow for urging to move deep inside the car on the display 11 installed on the floor in the car, for example.

FIG. 6 is an illustrative view illustrating a state in which the display 11 installed on the floor in the car displays the arrow urging to move deep inside the car.

Also, in a case where the guidance content indicating that the wheelchair might enter the car and clearly indicating the space for the wheelchair to enter in the car by the guidance content determining unit 8, for example, the guidance presentation processing unit 10 outputs audio indicating that there is a possibility that the wheelchair enters the car from the speaker 12. Also, as illustrated in FIG. 7, for example, the space in which the wheelchair enters is displayed on the display 11 installed on the floor in the car.

Figure 7:
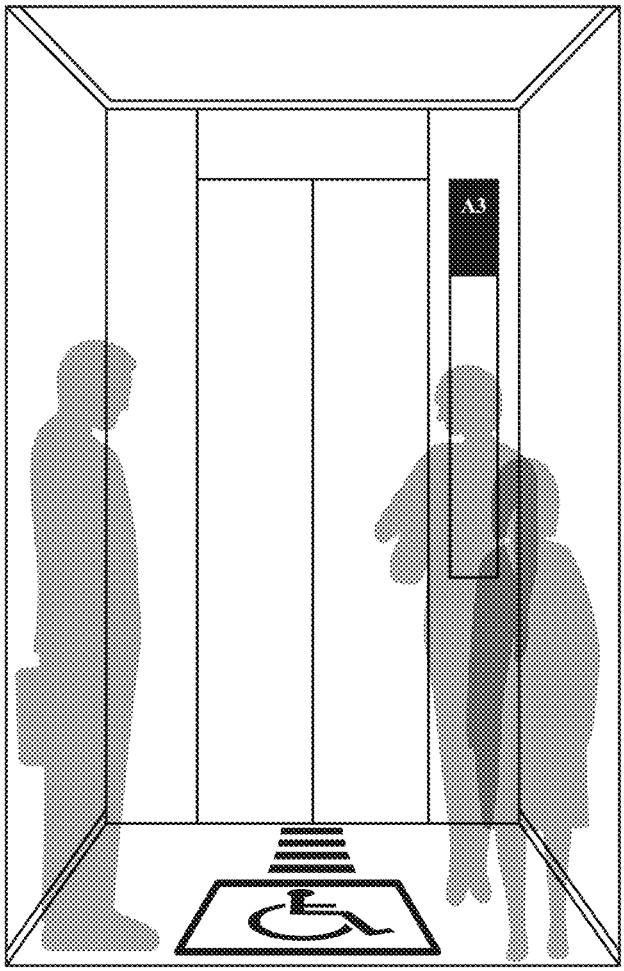
FIG. 7 is an illustrative view illustrating a state in which the display 11 installed on the floor in the car displays a space for a wheelchair to enter.

FIG. 7 is an illustrative view illustrating a state in which the display 11 installed on the floor in the car displays the space in which the wheelchair enters.

When the guidance content determining unit 8 determines the second guidance content, the guidance presentation processing unit 14 of the guidance presenting unit 13 presents the second guidance content to the user in the landing (step ST9 in FIG. 4).

That is, the guidance presentation processing unit 14 displays the guidance content indicating the congestion situation $C_a$ in the car on the display 15 installed in the elevator landing of the floor at which the car arrives next, or outputs the guidance content indicating the congestion situation $C_a$ in the car by voice from the speaker 16.

The guidance presentation processing unit 14 outputs, as the guidance content indicating the congestion situation $C_a$ in the car, audio from the speaker 16 indicating that it might be impossible to get on the car because of congestion in a case where the guidance content determining unit 8 determines the guidance content indicating that there is an impossibility to get on the car because of congestion, for example.

Also, in a case where the guidance content indicating the possibility that the wheelchair gets out of the car and clearly indicating the route of the wheelchair getting out of the car in the elevator landing is determined by the guidance content determining unit 8, for example, as the guidance content indicating the congestion situation $C_a$ in the car, the guidance presentation processing unit 14 outputs audio indicating that there is a possibility that the wheelchair gets out of the car from the speaker 16. Also, as illustrated in FIG. 8, for example, the route of the wheelchair which gets out of the car is displayed on the display 15 installed on the floor of the elevator landing.

Figure 8:
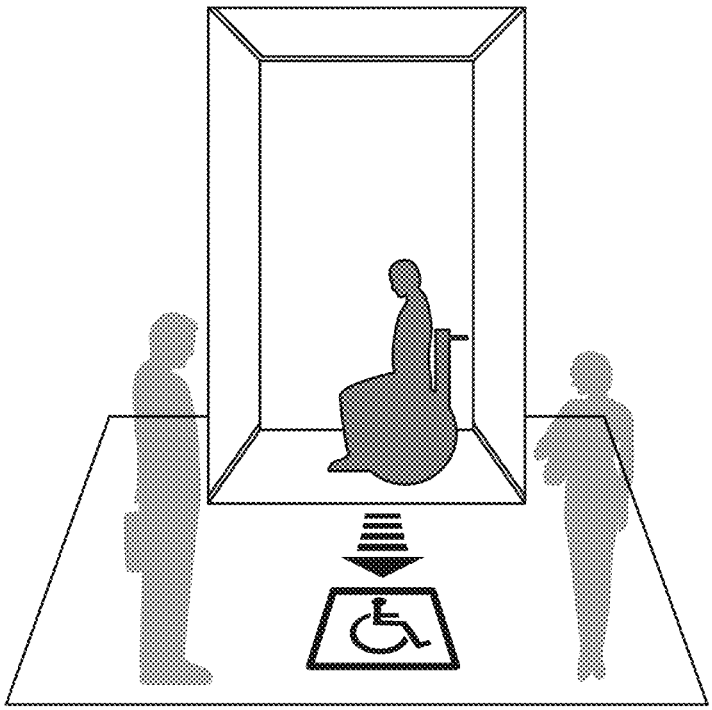
FIG. 8 is an illustrative view illustrating a state in which a display 15 installed on a floor in an elevator landing displays a route of the wheelchair getting out of the car.

FIG. 8 is an illustrative view illustrating a state in which the display 15 installed on the floor of the elevator landing displays the route of the wheelchair getting out of the car.

As is clear from the description above, according to the first embodiment, it is configured such that the guidance content determining unit 8 which determines the first guidance content which is the content represented to the user in the car on the basis of the situation in the elevator landing detected by the landing situation detecting unit 4 and determines the second guidance content being the content represented to the user in the elevator landing on the basis of the situation in the car detected by the in-car situation detecting unit 1 is provided, the guidance presenting unit 9 presents the first guidance content determined by the guidance content determining unit 8 to the user in the car, and the guidance presenting unit 13 presents the second guidance content determined by the guidance content determining unit 8 to the user in the elevator landing, so that there is an effect that it is possible to present the guidance according to the situation in the car and the situation in the elevator landing to the user. As a result, it is possible to smoothly get on and off and improve comfort.

Also, according to the first embodiment, it is configured such that the guidance content determining unit 8 determines the guidance content indicating the congestion situation in the elevator landing as the first guidance content, and determines the guidance content indicating the congestion situation in the car as the second guidance content, so that there is an effect that the user in the car and the user in the elevator landing may know the congestion situation in advance.

According to the first embodiment, it is configured such that the communication unit 7*a* which receives the destination information indicating the destination floor of the user from the information terminal of the user is provided, and the guidance content determining unit 8 estimates the congestion situation in the car after some of the users in the car get off on the elevator landing on the basis of the destination information that indicates the destination floor and is received by the communication unit 7*a* and the congestion situation in the car detected by the in-car congestion situation detecting unit 2 and determines the guidance content indicating the estimated congestion situation in the car as the second guidance content, so that there is an effect that the user in the elevator landing may know the congestion situation in the car at the time of getting on the car.

According to the first embodiment, it is configured such that, in a case where the situation in which the wheelchair is present is detected by the cart detecting unit 6, the guidance content determining unit 8 determines the guidance content indicating the possibility that the wheelchair enters the car as the first guidance content, so that there is an effect that the user in the car may know in advance that the wheelchair enters the car.

Also, according to the first embodiment, it is configured such that the guidance content determining unit 8 adds the guidance content that clearly indicates the space for the wheelchair to enter in the car as the first guidance content, and the guidance presenting unit 9 presents the possibility that the wheelchair enters the car and displays the space for the wheelchair to enter in the car, so that there is an effect that the space for the wheelchair to enter is secured smoothly, and the wheelchair may smoothly get on the car.

According to the first embodiment, it is configured such that, in a case where the situation in which the wheelchair is present is detected by the cart detecting unit 6, the guidance content determining unit 8 determines whether there is the space for the wheelchair to enter in the car from the congestion situation in the car, and determines the guidance content indicating dissuasion from getting on the car and suggestion for waiting the next car to be arrived when there is no space for the wheelchair to enter in the car, so that there is an effect of preventing deterioration in operation efficiency due to forcible intrusion.

According to the first embodiment, it is configured such that, in a case where the situation in which the wheelchair is present is detected by the cart detecting unit 3, the guidance content determining unit 8 determines the guidance content indicating the possibility that the wheelchair gets out of the car as the second guidance content, so that there is an effect that the user in the elevator landing may know in advance that the wheelchair gets out of the car.

Also, according to the first embodiment, it is configured such that the guidance content determining unit 8 adds the guidance content that clearly indicates the route of the wheelchair getting out of the car in the elevator landing as the second guidance content, and the guidance presenting unit 13 presents the possibility that the wheelchair gets out of the car and displays the route of the wheelchair getting out of the car in the elevator landing, so that there is an effect that the route on which the wheelchair gets out of the car is smoothly secured and the wheelchair may smoothly get out of the car.

Second Embodiment

Although the guidance content determining unit 8 determines the first guidance content being the content represented to the user in the car on the basis of the situation in the elevator landing detected by the landing situation detecting unit 4 and determines the second guidance content being the content represented to the user in the elevator landing on the basis of the situation in the car detected by the in-car situation detecting unit 1 in the above-described first embodiment, in a second embodiment, determining guidance content indicating an operating method of a car call button is further described.

Figure 9:
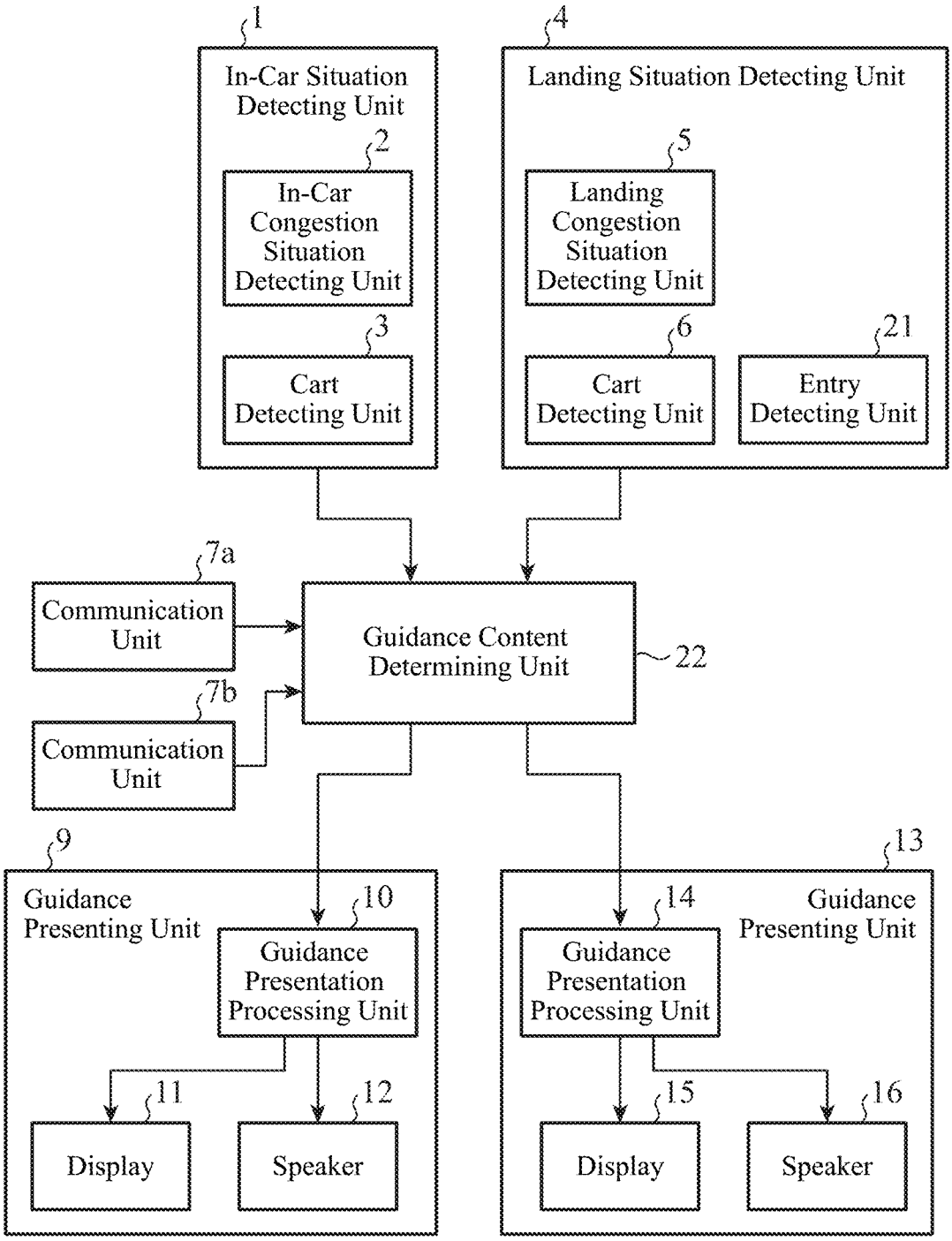
FIG. 9 is a configuration diagram illustrating a guidance presenting device according to a second embodiment of the present invention.
Figure 10:
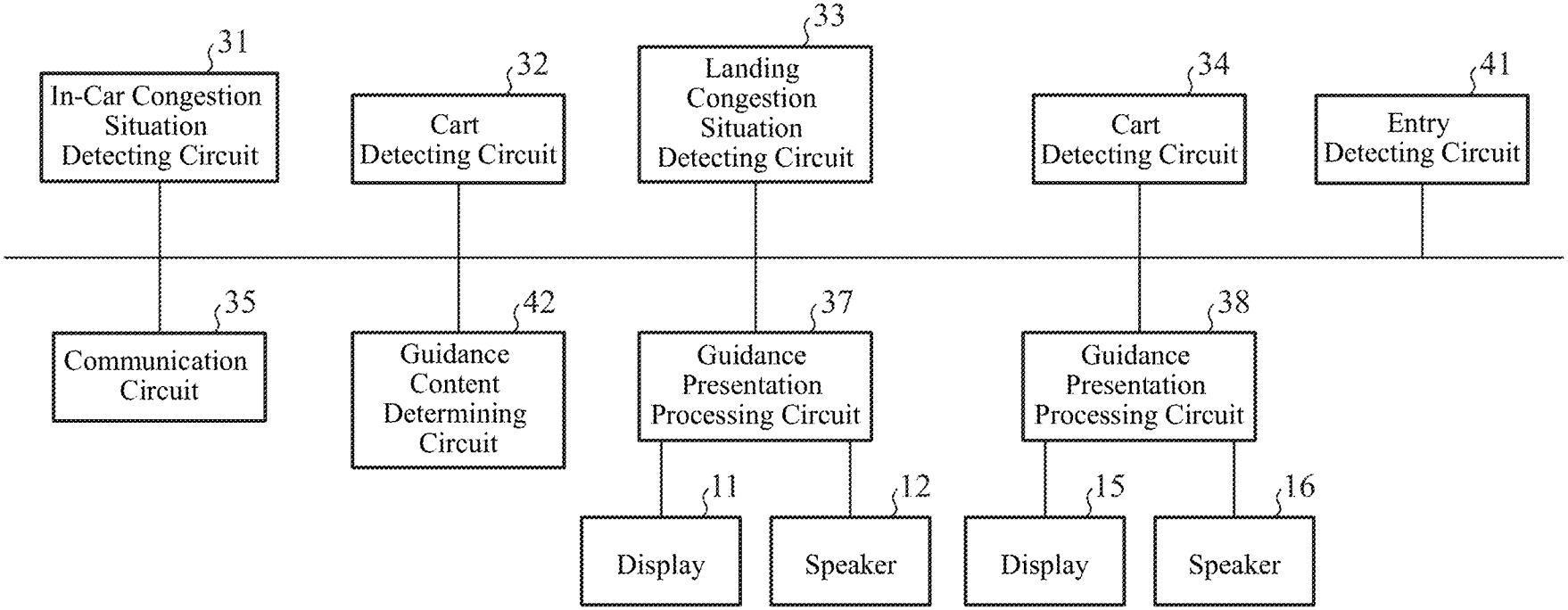
FIG. 10 is a hardware configuration diagram of the guidance presenting device according to the second embodiment of the present invention.

FIG. 9 is a configuration diagram illustrating a guidance presenting device according to the second embodiment of the present invention, and FIG. 10 is a hardware configuration diagram of the guidance presenting device according to the second embodiment of the present invention.

In FIGS. 9 and 10, the same reference signs as those in FIGS. 1 and 2 represent the same or corresponding parts, so that the description thereof is not repeated.

Figure 11:
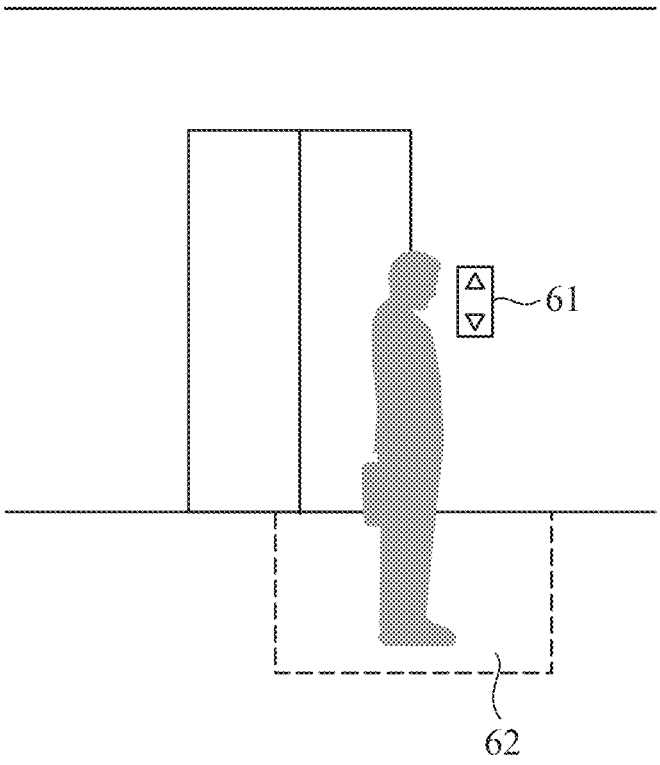
FIG. 11 is an illustrative view illustrating an elevator landing in which a call button of a car is installed.

FIG. 11 is an illustrative view illustrating an elevator landing in which a car call button is installed.

A landing situation detecting unit 4 includes a landing congestion situation detecting unit 5, a cart detecting unit 6, and an entry detecting unit 21.

The entry detecting unit 21 is implemented by, for example, an entry detecting circuit 41 in FIG. 10 and performs processing of detecting a situation in which a user enters a button installation area 62 in the elevator landing where a car call button 61 is installed as a situation of the elevator landing.

The car call button 61 includes a triangle-shaped push button and an inverted-triangle-shaped push button.

When the user pushes the triangle-shaped push button when going to an upper floor, a call request for the car going to the upper floor is output to a control device of an elevator not illustrated, and when the user pushes the inverted-triangle-shaped push button, a call request for the car going to a lower floor is output to the control device of the elevator.

The button installation area 62 is an area where the user can operate the car call button 61 by extending his/her hand.

A guidance content determining unit 22 is implemented by a guidance content determining circuit 42 in FIG. 10, for example, and performs processing of measuring elapsed time T from the detection of an entry situation by the entry detecting unit 21 and determining guidance content indicating an operating method of the call button 61 depending on personal information received by a communication unit 7*b* as second guidance content when the call button 61 is not operated before the elapsed time T exceeds a threshold Th.

In the second embodiment, the communication unit 7*b* receives not only destination information transmitted from an information terminal of the user but also the personal information transmitted from the information terminal of the user.

In the second embodiment, the personal information may include, for example, information indicating that the user is visually impaired, information indicating the nationality of the user, information indicating a height and an age of the user and the like.

In the second embodiment, the personal information is set in advance in the information terminal of the user, and in the elevator landing of the elevator, the personal information is automatically transmitted from the information terminal without special operation of the information terminal by the user.

In FIG. 9, it is supposed that an in-car congestion situation detecting unit 2, a cart detecting unit 3, the landing congestion situation detecting unit 5, the cart detecting unit 6, the entry detecting unit 21, the communication units 7*a* and 7*b*, the guidance content determining unit 22, a guidance presentation processing unit 10, a display 11, a speaker 12, a guidance presentation processing unit 14, a display 15, and a speaker 16 being components of the guidance presenting device are implemented by dedicated hardware as illustrated in FIG. 10, that is, an in-car congestion situation detecting circuit 31, a cart detecting circuit 32, a landing congestion situation detecting circuit 33, a cart detecting circuit 34, the entry detecting circuit 41, a communication circuit 35, a guidance content determining circuit 42, a guidance presentation processing circuit 37, the display 11, the speaker 12, a guidance presentation processing circuit 38, the display 15, and the speaker 16, respectively.

Herein, each of the in-car congestion situation detecting circuit 31, the cart detecting circuit 32, the landing congestion situation detecting circuit 33, the cart detecting circuit 34, the entry detecting circuit 41, the communication circuit 35, the guidance content determining circuit 42, the guidance presentation processing circuit 37, and the guidance presentation processing circuit 38 corresponds to, for example, a single circuit, a composite circuit, a programmed processor, a parallel-programmed processor, an ASIC, a FPGA, or a combination thereof.

However, the components of the guidance presenting device are not limited to those implemented by the dedicated hardware, and the guidance presenting device may also be implemented by software, firmware, or a combination of the software and firmware.

In a case where the guidance presenting device is implemented by the software, firmware or the like, it is possible to output the guidance content to a display 53 and a speaker 54 by storing a program for allowing a computer to execute procedures of the in-car congestion situation detecting unit 2, the cart detecting unit 3, the landing congestion situation detecting unit 5, the cart detecting unit 6, the entry detecting unit 21, the communication units 7*a* and 7*b*, the guidance content determining unit 22, the guidance presentation processing unit 10, and the guidance presentation processing unit 14 in a memory 51 illustrated in FIG. 3, and executing the program stored in the memory 51 by a processor 52 of the computer.

Operation is next described.

In the second embodiment, for example, a proximity sensor is installed in the vicinity of the button installation area 62 in the elevator landing, and when the user enters the button installation area 62, this proximity sensor outputs an entrance detection signal.

Upon receiving the entrance detection signal from the proximity sensor, the entry detecting unit 21 determines that the user enters the button installation area 62 and outputs the entrance detection signal to the guidance content determining unit 22.

While the proximity sensor outputs the entrance detection signal, the entry detecting unit 21 continuously outputs the entrance detection signal to the guidance content determining unit 22.

When the user leaves the button installation area 62 and the proximity sensor stops outputting the entrance detection signal, the entry detecting unit 21 stops outputting the entrance detection signal to the guidance content determining unit 22.

The guidance content determining unit 22 determines the first and second guidance contents as is the case with the guidance content determining unit 8 in FIG. 1, and upon receiving the entrance detection signal from the entry detecting unit 21, this activates a built-in timer to measure the elapsed time T after the user enters the button installation area 62.

In a case where the guidance content determining unit 22 receives operation information indicating that the car call button 61 is operated from the control device of the elevator not illustrated, or when the entrance detection signal is no longer output from the entry detecting unit 21, this stops the built-in timer and resets the elapsed time T to 0; however, when the operation information is not received from the control device of the elevator and the entrance detection signal is continuously output from the entry detecting unit 21, the elapsed time T increases.

The guidance content determining unit 22 compares the elapsed time T with a threshold Th set in advance, and when the elapsed time T becomes equal to or longer than the threshold Th, there is a possibility that the user has difficulty in operating the call button 61, so that the guidance content determining unit 22 determines the guidance content indicating the operating method of the call button 61 as the second guidance content. The threshold Th is determined to arbitrary time; this may be 30 seconds or 1 minute, for example.

For example, when the user is visually impaired, a child with a short height, an elderly person, a foreigner or the like, the user may have difficulty in operating the call button 61.

In a case where the personal information received by the communication unit 7*b* indicates that the user is visually impaired, the guidance content determining unit 22 determines, for example, the guidance content indicating that the call button 61 is installed beyond a guidance block for visually impaired person not illustrated provided on the floor and wall in the button installation area 62.

In a case where the personal information received by the communication unit 7*b* indicates that the user is a foreigner, the guidance content determining unit 22 determines the guidance content indicating the method of operating the call button 61 in the native language of the foreigner, for example.

In a case where the personal information received by the communication unit 7*b* indicates that the user is a child or an elderly person, for example, the guidance content determining unit 22 controls such that a camera installed in the vicinity of the button installation area 62 shoots an image of the child or the elderly person and the image of the camera is transmitted to the control room of the elevator, and allows an operator in the control room to notify the child and the elderly person of the operation of the call button 61 by voice while watching the image of the camera.

When the guidance content determining unit 22 determines the second guidance content, the guidance presentation processing unit 14 of a guidance presenting unit 13 presents the second guidance content to the user in the landing as in the above-described first embodiment.

In the second embodiment, the guidance content indicating the operating method of the call button 61 is also presented to the user in the landing.

As is clear from the above-description, according to the second embodiment, it is configured such that the landing situation detecting unit 4 includes the entry detecting unit 21 which detects the situation in which the user enters the button installation area 62 in the elevator landing in which the car call button 61 is installed as the situation in the elevator landing, and the guidance content determining unit 22 measures the elapsed time T from the detection of an entry by the entry detecting unit 21 and determines the guidance content indicating the operation method of the call button 61 as the second guidance content when the call button 61 is not operated before the elapsed time T becomes longer than the threshold Th, so that the user not knowing how to operate the call button 61 may also smoothly get on the car.

Also, according to the second embodiment, it is configured such that the communication unit 7*b* which receives the personal information of the user from the information terminal of the user is provided, and the guidance content determining unit 22 determines the guidance content indicating the operation method of the call button 61 depending on the personal information received by the communication unit 7*b*, so that there is an effect that the guidance content suitable for the user may be determined.

In the first and second embodiments described above, the guidance presentation processing units 10 and 14 display the guidance content on the displays 11 and 15, and the guidance content is output by voice from the speakers 12 and 16, but this is merely an example; for example, the guidance content may be displayed in a space in the car or a space in the elevator landing.

Meanwhile, in the invention of the present application, the embodiments may be freely combined, any component of each embodiment may be modified, or any component may be omitted in each embodiment without departing from the scope of the invention.

INDUSTRIAL APPLICABILITY

The present invention is suitable for a guidance presenting device and a guidance presenting method for presenting guidance to a user who uses an elevator.

REFERENCE SIGNS LIST

1: In-car situation detecting unit, 2: In-car congestion situation detecting unit, 3: Cart detecting unit, 4: Landing situation detecting unit, 5: Landing congestion situation detecting unit, 6: Cart detecting unit, 7*a*, 7*b*: Communication unit, 8: Guidance content determining unit, 9: Guidance presenting unit (first guidance presenting unit), 10: Guidance presentation processing unit, 11: Display, 12: Speaker, guidance presentation circuit, 13: Guidance presenting unit (second guidance presenting unit), 14: Guidance presentation processing unit, 15: Display, 16: Speaker, 21: Entry detecting unit, 22: Guidance content determining unit, 31: In-car congestion situation detecting circuit, 32: Cart detecting circuit, 33: Landing congestion situation detecting circuit, 34: Cart detecting circuit, 35: Communication circuit, 36: Guidance content determining circuit, 37: Guidance presentation processing circuit, 38: Guidance presentation processing circuit, 41: Entry detecting circuit, 42: Guidance content determining circuit, 51: Memory, 52: Processor, 53: Display, 54: Speaker, 61: Call button, 62: Button installation area.

The invention claimed is:

1. A guidance presenting device comprising:

a processor; and a memory storing instructions which, when executed by the processor, causes the processor to perform processes of:

detecting a situation a car of an elevator;

determining second guidance content being content represented to a user elevator landing on a basis of the detected situation in the car; and presenting the determined second guidance content to the user in the elevator landing, wherein the processor detects a congestion situation in the car as the situation in the car, the processor determines, as the second guidance content, guidance content indicating the detected congestion situation in the car, the processor further perform processes of;

receiving destination information indicating a destination floor of the user from a portable information terminal of the user, wherein the processor estimates the congestion situation in the car after some users in the car get off on the elevator landing on a basis of the received destination information which indicates the destination floor and the detected congestion situation in the car, and determines the guidance content indicating the estimated congestion situation in the car as the second guidance content, wherein the processor detects a situation in which a cart is present in the car as the situation in the car, and in a case where the situation in which the cart is present is detected, the processor determines guidance content indicating a possibility that the cart gets out of the car as the second guidance content, wherein the processor adds guidance content which clearly indicates a route of the cart getting out of the car in the elevator landing as the second guidance content, and the processor presents a possibility that the cart gets out of the car and displays the route cart getting out of the car in the elevator landing.

2. A guidance presenting device comprising:

a processor; and a memory storing instructions which, when executed by the processor, causes the processor to perform processes of:

detecting a situation in a car of an elevator;

determining second guidance content being content represented to a user in an elevator landing on a basis of the detected situation in the car; and presenting the determined second guidance content to the user in the elevator landing, wherein the processor detects a congestion situation in the car as the situation in the car, the processor determines, as the second guidance content, guidance content indicating the detected congestion situation in the car, the processor further performs processes of receiving destination information indicating a destination floor of the user from an information terminal of the user, wherein the processor estimates the congestion situation in the car after some of users in the car get off on the elevator landing on a basis of the received destination information which indicates the destination floor and the detected congestion situation in the car, and determines the guidance content indicating the estimated congestion situation in the car as the second guidance content, wherein the processor detects a situation in which a cart is present in the car as the situation in the car, and in a case where the situation in which the cart is present is detected, the processor determines guidance content indicating a possibility that the cart gets out of the car as the second guidance content, wherein the processor adds guidance content which clearly indicates a route of the cart getting out of the car in the elevator landing as the second guidance content, and the processor presents a possibility that the cart gets out of the car and displays the route of the cart getting out of the car in the elevator landing.

3. A guidance presenting device comprising: a processor; and a memory storing instructions which, when executed by the processor, causes the processor to perform processes of:

detecting a situation in a car of an elevator;

determining second guidance content being content represented to a user in an elevator landing on a basis of the detected situation in the car; and presenting the determined second guidance content to the user in the elevator landing, wherein the processor detects a congestion situation in the car as the situation in the car, the processor determines, as the second guidance content, guidance content indicating the detected congestion situation in the car, the processor further performs processes of receiving destination information indicating a destination floor of the user from an information terminal of the user, wherein the processor estimates the congestion situation in the car after some of users in the car get off on the elevator landing on a basis of the received destination information which indicates the destination floor and the detected congestion situation in the car, and determines the guidance content indicating the estimated congestion situation in the car as the second guidance content, the processor detects a situation in which the user enters a button installation area in the elevator landing in which a car call button is installed as the situation in the elevator landing, and the processor measures an elapsed time from detection of an entry situation and determines guidance content indicating an operation method of the call button as the second guidance content when the call button is not operated before the elapsed time exceeds a threshold.

4. A guidance presenting method comprising:

detecting a situation in a car of an elevator;

determining second guidance content being content represented to a user in the elevator landing on a basis of the detected situation in the car;

presenting the determined second guidance content to the user in the elevator landing;

detecting a congestion situation in the car as the situation in the car;

determining, as the second guidance content, guidance content indicating the detected congestion situation in the car;

receiving destination information indicating a destination floor of the user from an information terminal of the user;

estimating the congestion situation in the car after some of users in the car get off on the elevator landing on a basis of the received destination information which indicates the destination floor and the detected congestion situation in the car and determining the guidance content indicating the estimated congestion situation in the car as the second guidance content;

detecting a situation in which a cart is present in the car as the situation in the car;

determining, in a case where the situation inwhich the cart is present is detected, guidance content indicating a possibility that the cart gets out of the car as the second guidance content;

adding guidance content which clearly indicates a route of the cart getting out of the car in the elevator landing as the second guidance content; and presenting a possibility that the cart gets out of the car and displaying the route of the cart getting out of the car in the elevator landing.

5. A guidance presenting method comprising:

detecting a situation in a car of an elevator;

determining second guidance content being content represented to a user in the elevator landing on a basis of the detected situation in the car;

presenting the determined second guidance content to the user in the elevator landing;

detecting a congestion situation in the car as the situation in the car;

determining, as the second guidance content, guidance content indicating the detected congestion situation in the car;

receiving destination information indicating a destination floor of the user from an information terminal of the user;

estimating the congestion situation in the car after some of users in the car get off on the elevator landing on a basis of the received destination information which indicates the destination floor and the detected congestion situation in the car and determining the guidance content indicating the estimated congestion situation in the car as the second guidance content;

detecting a situation in which the user enters a button installation area in the elevator landing in which a car call button is installed as the situation in the elevator landing; and measuring an elapsed time from detection of an entry situation and determining guidance content indicating an operation method of the call button as the second guidance content when the call button is not operated before the elapsed time exceeds a threshold.

* * * * *